US006149551A

United States Patent [19]

Pyles et al.

[11] Patent Number: 6,149,551

[45] Date of Patent: Nov. 21, 2000

[54] FOLDABLE ELLIPTICAL EXERCISE MACHINE

[75] Inventors: Nathan Pyles, Lake Mills, Wis.; Kun-Chuan Lo, Taichung, Taiwan; Chang-Hsin Yang, Taichung, Taiwan; Kuei-Sen Chen, Taichung, Taiwan

[73] Assignees: Epix, Inc., Lake Mills, Wis.; Johnson Metal Industries, Taiwan

[21] Appl. No.: 09/076,286

[22] Filed: May 12, 1998

[51] Int. Cl.[7] ..... A63B 69/16; A63B 22/04

[52] U.S. Cl. ..... 482/52; 482/51

[58] Field of Search ..... 482/51, 52, 53, 482/57, 70, 71, 79, 80, 908, 62, 54

[56] References Cited

U.S. PATENT DOCUMENTS

| | | | |
|---|---|---|---|
| 5,383,829 | 1/1995 | Miller . | |
| 5,529,554 | 6/1996 | Eschenbach . | |
| 5,549,526 | 8/1996 | Rodgers, Jr. . | |
| 5,593,372 | 1/1997 | Rodgers | 482/57 |
| 5,779,599 | 7/1998 | Chen | 482/57 |
| 5,823,917 | 10/1998 | Chen | 482/70 |
| 5,846,166 | 12/1998 | Kuo | 482/70 |
| 5,897,460 | 4/1999 | McBride et al. | 482/54 |
| 5,904,637 | 5/1999 | Kuo | 482/54 |

FOREIGN PATENT DOCUMENTS 297 20 158 U1 11/1997 Germany .

OTHER PUBLICATIONS

PCT International Search Report, 5 pgs.

*Primary Examiner*—Stephen R. Crow
*Attorney, Agent, or Firm*—Lathrop & Clark LLP

[57] ABSTRACT

Several embodiments of a foldable and transportable elliptical exercise machine are disclosed which include pedal arms and optional corresponding load bearing rails that are folded to an upright position for storage and transportation. The pedal arms are shaped to optimize user safety and exercise productivity. The device housing can include movable portions that optimize safety during use, but accommodate the pedal arms in the upright and folded position.

83 Claims, 7 Drawing Sheets

FOLDABLE ELLIPTICAL EXERCISE MACHINE

FIELD AND BACKGROUND OF THE INVENTION

This invention relates generally to exercise machines and more particularly to a folding elliptical exercise machine having foldable pedal arms that can be moved to an upright position for storage and portability.

Elliptical exercise machines are known which included a crank pulley rotatably mounted on a frame and having crank arms extending outwardly therefrom. Attached to distal ends of the crank arms are rearwardly extending pedal arms on which a user stands and alternates his or her weight in a stepping motion to rotate the crank pulley and the position of the user's feet. Due to the geometry of the pedal arms extending rewardly from the crank arms, a user standing in fixed positions on the pedal arms will have his or her feet move in a generally elliptical pattern, as viewed from the side. This motion simulates a walking or running motion and yet provides continuous foot and leg support for the user to minimize detrimental foot and leg impact.

Other types of elliptical exercise machines are known which have pedal arms that extend forward from a crank pulley and the user stands on the pedal arms facing in a direction away from the crank pulley. To maintain the user's balance and to maintain a substantially level foot support surface, the distal ends of the pedal arms must be supported on inclined planes joined to a frame supporting the elliptical machine. Further, handle bars must be positioned on the opposite end of the machine from the mechanism. Such an arrangement is complicated, heavy, and very difficult to move due to the weight of the frame and the size of the device has a whole.

Crank pulleys can be connected to an alternator or fly wheel to maintain momentum or constant speed for the exercise machine. With either option, having the pedal arms supported on a complicated frame as described above adds to the difficulty in moving the elliptical exercise machine. Portability and space constraints are critical factors in the home exercise machine market and, thus the prior art machine arrangement is not conducive to home exercise machine sales.

Other elliptical exercise machines are designed to be collapsible by folding down the upper portions of the frame, the handle bars, and the pedal arms to a low position so that the machine can then be moved to a storage location. With such a collapsible design, there is no reduction in floor space requirements when the machine is folded so the machine must be moved to a storage location to obtain the benefits of the collapsible design.

Thus, there is in need for a portable elliptical motion exercise machine having folding pedal arms and related frame components to minimize storage space requirements and render the exercise machine portable.

SUMMARY OF THE INVENTION

An elliptical exercise machine in accordance with present invention overcomes the disadvantages of prior art machines using machine components that are foldable and compactly arranged to make the machine convenient for storage and portability. One embodiment of the present invention includes: a frame; a crank pulley having an axis rotatably mounted on the frame; a pair of opposing crank arms, each crank arm having a first end fixed to the crank pulley axis and a second end extending radially outwardly from the axis in a direction opposite the other crank arm; and a pair of pedal arms each having a first end rotatably joined to the second end of a respective crank arm, the central portion extending rearwardly from the pedal arm first end and a second end rearward of the central portion, and the pedal arms being pivotable between a use position and an upright folded position.

The elliptical exercise machine may include a pair of rails pivotably joined to the frame and each having a load bearing surface for supporting the second end of respective pedal arms and the rails are pivotable between a use position and an upright folded position. In a variation of this embodiment, there is a housing joined to the frame, the housing defining an interior space in which the crank pulley and the crank arms are disposed; the housing having a movable portion, the movable portion having a closed position corresponding to the pedal arm use position, and an open position corresponding to the pedal arm upright folded position to permit a more compact folded arrangement.

Another embodiment of an elliptical exercise machine in accordance with present invention includes: a frame; a crank pulley having an axis rotatably mounted on the frame; a pair of opposing crank arms, each crank arm having a first end fixed to the crank pulley axis and a second end extending radially outwardly from the axis in a direction opposite the other crank arm; and a pair of pedal arms each having a first end rotatably joined to the second end of a respective crank arm, a central portion extending rearwardly from the pedal arm first end, and a rear end portion extending downwardly from the central portion and terminating at a second end, wherein the pedal arm central portion is horizontal when the corresponding crank arm is horizontal.

In any of the above the embodiments of the elliptical exercise machine there may be included a wheel rotatably mounted on the second end of a pedal arm or a foot platform mounted on the central portion of a pedal arm. The exercise device may include an upwardly extending console mast fixed to the frame and may also include a handle bar. The exercise devices may also include a fly wheel rotatably mounted on the frame and a drive belt for transmitting inertia from the fly wheel to the crank pulley.

When a housing with movable portions for accommodating the pedal arms in the upright folded position is used, it is preferable that the movable portions move from the open position to the closed position automatically when the pedal arms are moved from the upright folded position toward the use position for user convenience. The movable portions may be pivoting doors and may be moved automatically using springs.

The exercise machines may also include a lock for releasably securing the pedal arms in the upright folded position, and when pivoting rails are used, it is preferable that the machine include a lock for releasably securing the rails in the upright folded position. Also, when pivoting rails are included, there may be a single lock for releasably securing a pedal arm to a corresponding rail in the upright folded position for simplicity. The lock in this latter embodiment may included a bent wire fixed to the bottom of a pedal arm and defining a resilient hook for engaging an end of a corresponding rail.

The frame of the exercise machines preferably includes four spaced apart support points defining a horizontal planar boundary above which the center of gravity of the exercise device is positioned when the pedal arms are in the upright folded position. When folding rails are used, the center of gravity of the exercise device in the upright folded position is also above the horizontal planar boundary. For ease of transporting the exercise machines, at least two of the support points should each include a wheel onto which the exercise machines may be tilted and rolled.

In other alternate embodiments, the pedal arms or the rails or both can be removably attached to the exercise machine. Further, the pedal arms or rails can include telescoping components to accomplish similar results.

As stated above, there may be a foot platform attached to each pedal arm. The foot platforms may be adjustable in their position on the pedal arms by including: a base plate fixed to the pedal arm and extending laterally outwardly from each side of the pedal arm and defining a plurality of position holes along the longitudinal line; a foot plate slidably engaged to the base plate along a longitudinal line; and a spring-loaded lock can be fixed to the foot plate and selectively engagable with any one of the position holes on the base plate. The foot plate may include a pair of inwardly extending lateral flanges for slidably engaging the laterally extending portions of the base plate.

Another adjustable foot platform for use with exercise machines, may include: a base plate fixed to the pedal arm and having a plurality of position holes along a longitudinal line; and a toe piece selectively engagable with any one of the position holes on the base plate and defining a toe-securing cavity. Again, a spring-loaded lock pin may be mounted on the toe piece for selectively engaging any one of the position holes on the base plate.

DETAILED DESCRIPTION OF THE DRAWINGS

Figure 1:
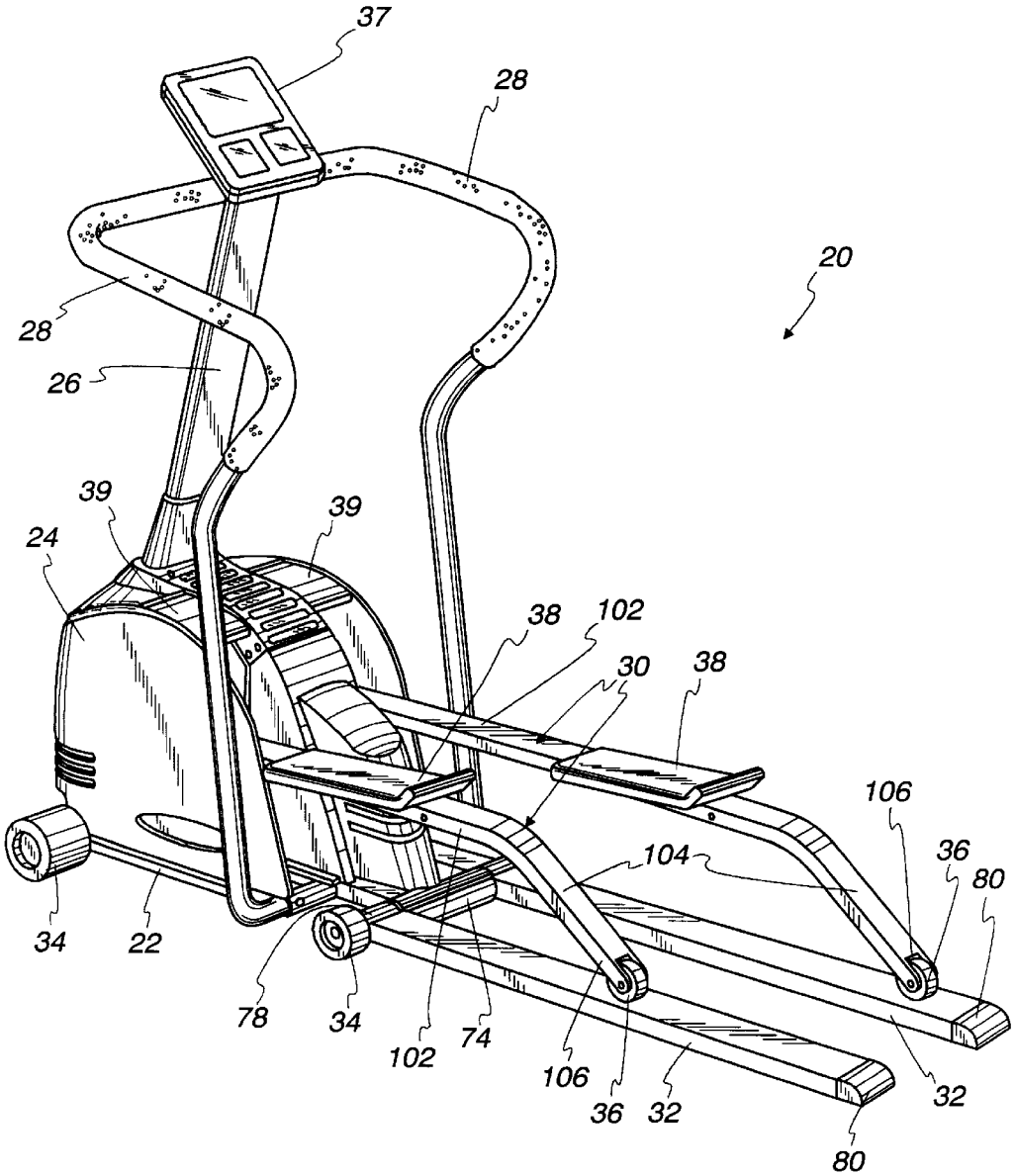
FIG. 1 is a perspective view of a foldable elliptical exercise machine in accordance with the present invention.

In the following detailed description of drawings, the same reference numeral will be used for the same element illustrated in the various figures. Illustrated in FIG. 1 is a folding elliptical exercise machine 20 in accordance with present invention including: a frame 22; a housing 24; an upright console mast 26; handle bars 28; a pair of rearwardly extending pedal arms 30; and a corresponding pair of rearwardly extending rails 32.

The frame 22 includes two pairs of frame wheels 34 for transporting the elliptical exercise machine 20. The pedal arms 30 each include a rearward wheel 36 for rolling on the corresponding rail 32. Also, each pedal arm 30 includes a foot platform 38 on which a user stands while exercising.

As illustrated, the housing 24 is a stylized case having rounded corners and various designs and locations for logos. The housing 24 is intended to protect a user and others nearby from the internal working components while the exercise machine 20 is in use and also to conceal the internal working components described below. Preferably, the housing 24 is made of plastic that is both durable and lightweight to reduce the overall weight of the exercise machine 20.

Figure 4:
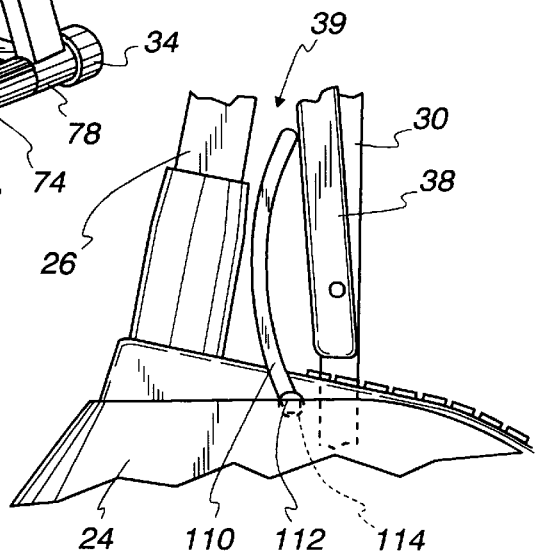
FIG. 4 is a partial side view of the elliptical machine housing with a movable portion in an opened position to accommodate a pedal arm in the upright folded position.

To optimize safety, the housing 24 includes movable portions 39 that accommodate the pedal arms 30 when they are in the upright and folded position as described more completely below and as illustrated and FIG. 4. Preferably, the movable portions are shaped to appear to be integral with the housing 24. It is also desirable that the movable portions 39 be made of the same or similar materials as the housing 24. Additional details of the movable portions 39 are discussed below in relation to FIG. 4.

The upright console mast 26 has at its upper end an electronic control panel 37 which displays information such as machine rotations per minute, calories burned, heart rate, distance traveled, among others, and may also be used to house controls for varying resistance of the machine to the user's input or other similar functions.

The handle bars 28 are also joined the frame 22 in any convenient manner that provides ready access to a user for comfort and safety. Preferably, the handle bars 28 are covered with an appropriate sweat-resistant and slip-resistant material over all surfaces reasonably accessible to a person exercising or moving the machine 20. Handle bars 28 should also be shaped to provide the additional function of tilting the exercise machine 20 onto at least two of the frame wheels 34 for transportation of the exercise machine 20. Although illustrated as having a front pair and rear pair of wheels 34, the exercise machine 20 only requires one pair of frame wheels 34 to transport the exercise machine 20. By providing two pairs of wheels 34, the exercise machine 20 can be tilted forward or rearward to transport to machine for added convenience.

Figure 2:
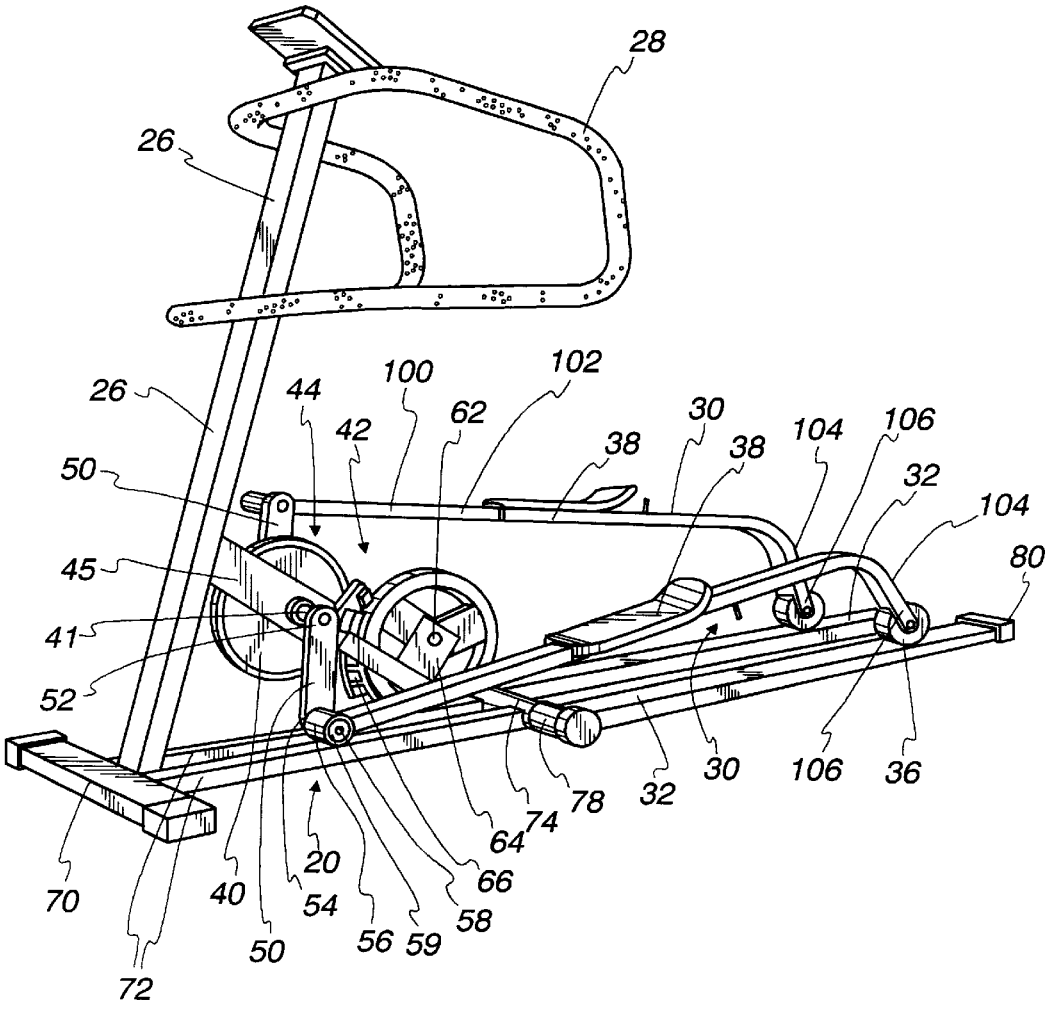
FIG. 2 is a perspective view of the elliptical machine with the housing removed to reveal a crank pulley, a pair of opposing crank arms, and a fly wheel for use with the foldable elliptical machine of FIG. 1.

FIG. 2 is the folding elliptical exercise machine 20 of FIG. 1 from a different perspective and with the housing 24 removed to reveal details of the frame 24 and an internal mechanism including a crank pulley 40 rotatably mounted on the frame 22 at an axis 41, and a fly wheel 42 also rotatably mounted on the frame 22 and joined to the crank pulley 40 by a belt 44. Also illustrated in FIG. 2 are a pair of opposing crank arms 50, each crank arm 50 having a first end 52 fixed to the crank pulley 40 at the crank pulley axis 41 and a second end 54 extending radially outwardly from the axis 41 in a direction opposite the other crank arm, as illustrated. The axis 41 extends transversely beyond the crank pulley 40 and a frame component 45 to provide clearance for the crank arms 50 as they rotate. The crank pulley 40 may be positioned adjacent to a single frame component 45 or between a pair of frame components for stability, and the crank pulley axis 41 will be joined to the frame component 45 using suitable cartridge bearings, for example.

Each pedal arm 30 preferably includes a transverse cylindrical tube 56 that is joined to a corresponding crank arm 50 over a transversely extending crank arm shaft 58. The tube 56 has pressed in each of its ends, a ball bearing cartridge 59 or other suitable bearing member, which are then pressed over the crank arm shaft 58 for a freely rotatable connection therebetween. Other connection types can result in a similar rotatable connection and are within the scope of the present invention.

Figure 3:
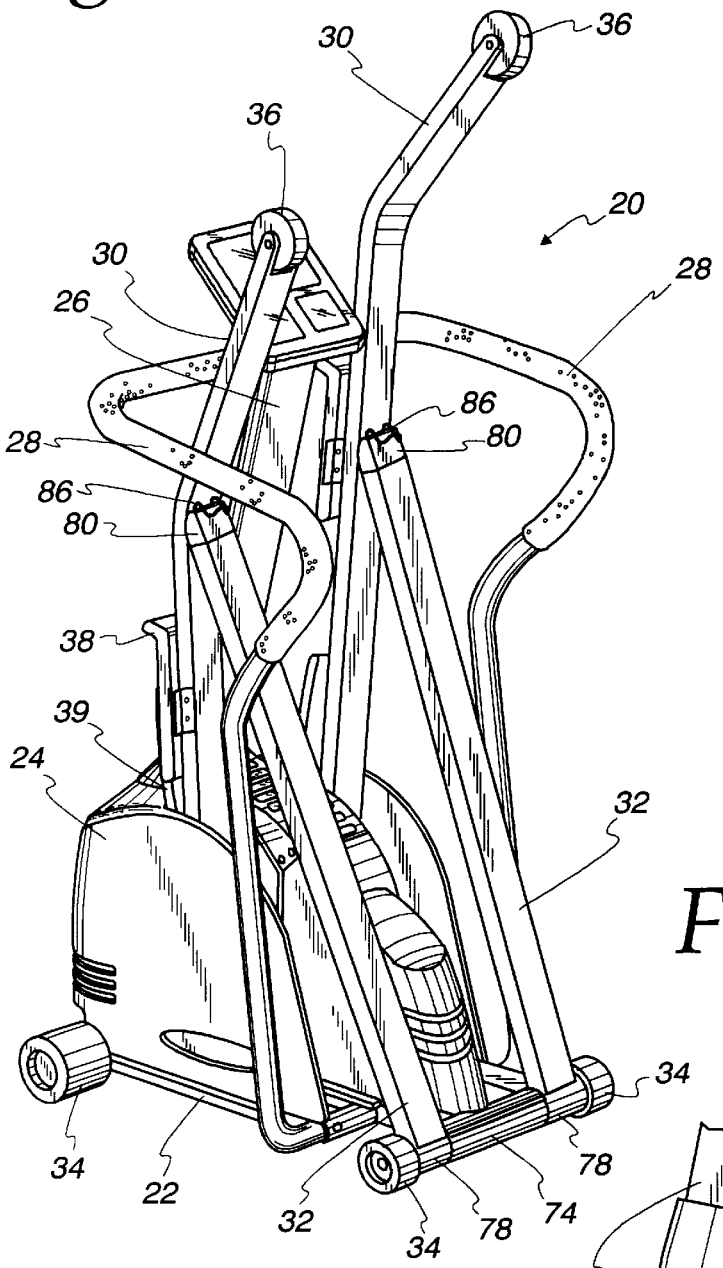
FIG. 3 is a perspective view of the foldable elliptical exercise machine of FIG. 1 in the upright folded position.
Figure 5:
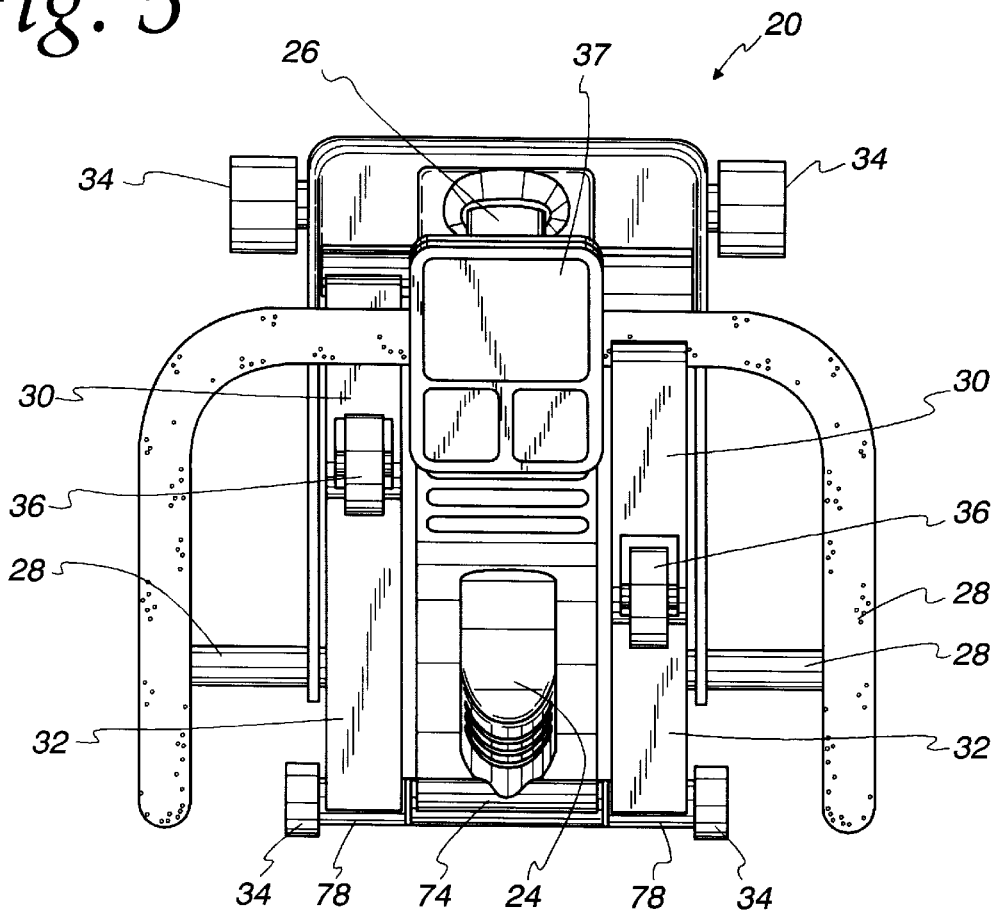
FIG. 5 is a view from the top when the elliptical machine is in the upright folded position.

With this construction, it is clear that the pedal arms 30 can rotate freely relative to the crank arms 50 for smooth exercising movement. Further, using a freely rotatable connection between the pedal arms 30 and the crank arms 50 with no other impediment to pedal arm 30 movement, the pedal arms 30 are free to be rotated from the use position illustrated in FIGS. 1 and 2 to an upright folded position as illustrated in FIGS. 3–5. In the upright folded position, substantially less floor space is required to store the exercise machine 20 and the exercise machine can be easily tilted onto frame wheels 34 for transporting in a manner similar to maneuvering a hand cart. Alternately, the pedal arms 30 can be removable by sliding them laterally to be disengaged from the crank pulley axis 41. A suitable safety pin (not illustrated) can be used to prevent inadvertent disengagement while the machine 20 is in use.

The fly wheel 42 is joined to frame at a fly wheel axis 62 which is mounted to a frame bracket 64. Fly wheel 42 can be of any suitable construction or may even be replaced by a motor for controlling the speed of the exercise machine 20. The fly wheel 42 can be controlled by a suitable mechanism such as a magnetic resistance mechanism 66, alternator, wind or air fan, or a friction resistance device.

The frame 22 can include a variety of components to accommodate a mounting location for all the various mechanical components and to provide stability while the exercise machine 20 is in use, in storage, or being transported. Although depicted without frame wheels, the embodiment in FIG. 2, includes a front transverse member 70, a pair of rearwardly extending longitudinal members 72, and a rear transverse member 74 all welded together and made of suitable materials such as carbon steel or other high-strength low-weight alloy.

Preferably, the rear transverse member 74 is cylindrically tubular and is pivotably joined to the rearwardly extending rails 32 as illustrated. For continuity, the rearwardly extending rails have at their forward ends cylindrical sections 78 that are joined to the rear transverse member 74 using a suitable bearing such as nylon or other synthetic bearing material.

With this construction, the rails 32 lie flat on a support surface in the use position as illustrated in FIGS. 1,2,11, and 12 even when the support surface is not completely flat or horizontal. Further, by using a pivot connection to the frame 22, the rails 32 can be folded to an upright storage position as illustrated in FIGS. 3,4,5, and 6 to significantly reduce floor space requirements when the exercise machine 20 is not in use and bulk when the exercise machine is being transported. Alternately, the rails 32 can be releasably connected to the frame 22 with a nearly identical connection, but having a safety pin (not illustrated) to prevent inadvertent separation when in use.

It further can be seen that the pedal arms 30 provide a surface on which a user's feet are positioned for exercise, and the rails 32 provide a load bearing surface on which the pedal arm wheels 36 roll as the pedal arms 30 move forward and back and pivot while in use. Although the rails 32 provide a convenient load bearing surface for the pedal arms 30, they are not necessary for use with the present invention because the pedal arms 30 could ride on a smooth floor surface (not illustrated). Preferably, the rails 32 have end caps 80 that have a curved upper surface (see FIG. 6) for engagement with the lock 86 described below.

Figure 6:
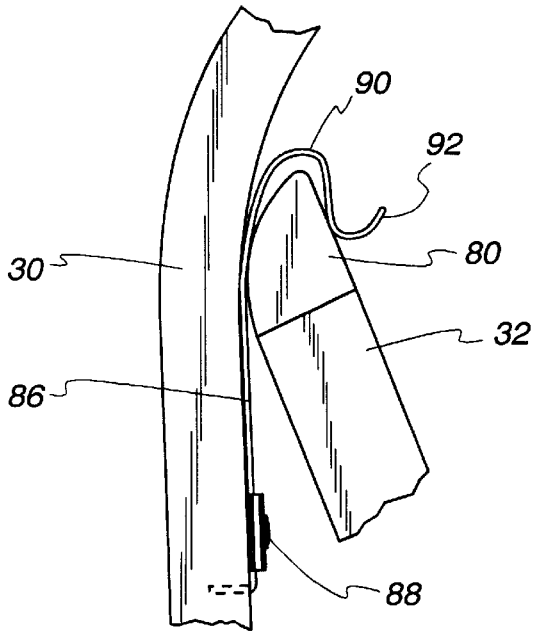
FIG. 6 is a partial side view of a pedal arm releasably connected to a corresponding rail by a lock when both the pedal arm and rail are in the upright folded position.
Figure 7:
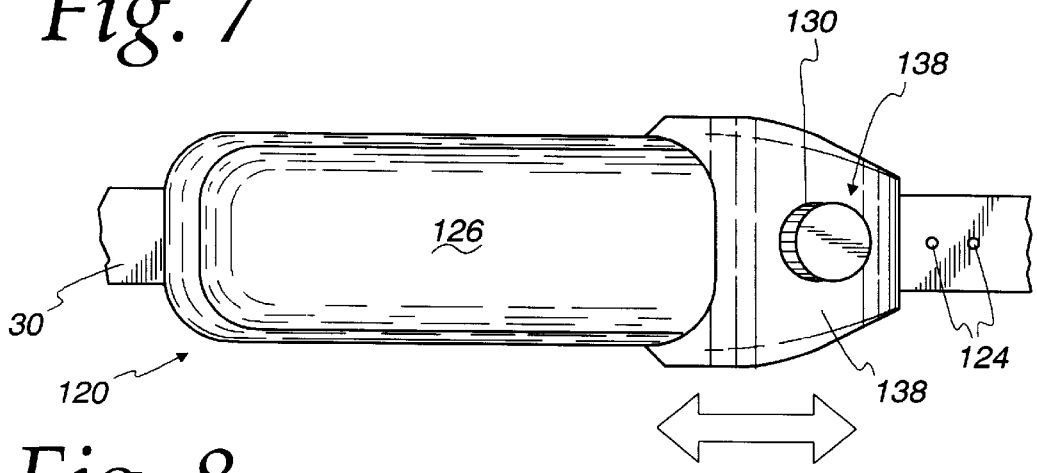
FIG. 7 is a partial top view of pedal arm having an adjustable toe plate mounted thereon.
Figure 8:
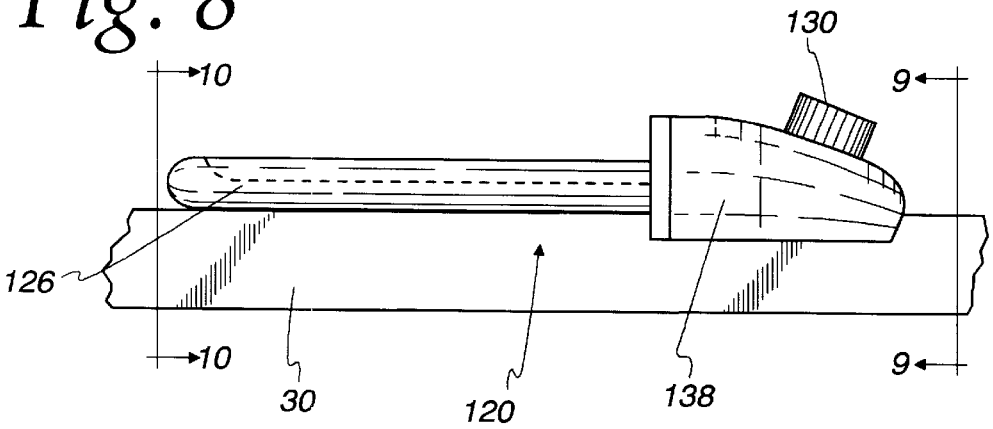
FIG. 8 is a partial side view of the pedal arm and adjustable toe plate of FIG. 7.

Preferably, when the pedal arms 30 and the rails 32 are in the upright folded position, they are joined together using the a suitable lock 86 as illustrated in FIG. 6. The illustrated lock 86 is a bent wire bolted to the bottom of each pedal arm 30 using a suitable bolt and washer arrangement 88. The lock 86 preferably has a hook portion 90 that is resilient for engaging a rearward end or the end cap 80 of a corresponding rail 32. In addition, the lock 86 preferably includes a camming surface 92 that is engaged by the rail 32 or the rail end cap 80 as the rail 32 is brought to its upright and folded position to urge the hook portion 90 to yield temporarily to the force of the rail 32 until rail 32 is engaged by the hook portion 90, at which time the camming surface 92 returns to its original position. Further, when desired to return the exercise machine 20 to its use position, the camming surface 92 can be used to resiliently bend the hook portion 90 out of the way to pull down the rail 32. The hook portion 90 in no way interferes with use of the exercise machine 20 or the pedal arms 30 because it is positioned on the underside of each pedal arm 30 which are bent or otherwise shaped as illustrated to keep the underside of the pedal arm 30 well above the rail 32 or other support surface. Other locking mechanisms are within the scope of the present invention including, snap locks, resilient tabs, spring-loaded or sliding pins, etc.

Figure 12:
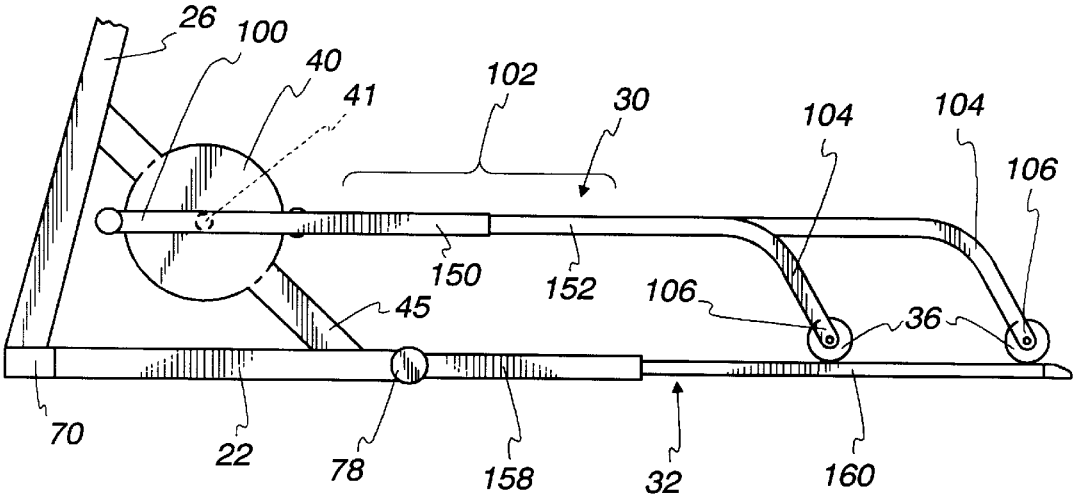
FIG. 12 is a partial side view of a telescoping pedal arm and rail in accordance with the present invention.

A further improvement of the present invention is the use of pedal arms 30 in the shape as illustrated, which includes a front end 100, a central portion 102 extending rearward from the front end 100, and a downwardly extending portion 104 rearward of the central portion 102 and terminating at a second end 106. The vertical dimension of the downwardly extending portion 104 is substantially equal to the height of the crank pulley axis 41 when the pedal arm central portion 102 is horizontal, taking into account the presence or absence of rails 32. As illustrated in FIG. 12, when the pedal arm central portions 102 are horizontal, so will be the crank arms 50 even though the crank arms 50 will be extending in opposite (forward and rearward) directions. Such an arrangement is critical to proper exercise technique because it maintains a users feet close to a horizontal position through much of the range of motion, and it alternates the user's feet between a slightly upturned position and a slightly position which is similar to a natural waking or running motion. Some prior art machines have pedal arm arrangements that always direct a user's feet in a declined or toe down position, which results in an unnatural foot and leg movement and may unduly strain some muscles.

As stated above, the housing 24 includes movable portions 39 that accommodate the pedal arms 30 in the upright and folded position. As illustrated in FIG. 4, one embodiment of a movable portion 39 is a pivoting door 110 joined to the housing at a pivot point 112. The door 110 is arc-shaped to conform to the shape of the housing 24, but the door 110 can be any shape. A torsion spring 114 is positioned at the pivot point 112 to urge the door 110 from the open position, as illustrated and FIG. 5, to the closed position as illustrated in FIG. 1, for example. Thus, when the pedal arm 30 is moved to its upright and folded position, the door 110 is pushed to the open position for storage. When the pedal arm 30 is moved to its downward and use position, the door 110 automatically closes at the urging of the torsion spring 114. Although the embodiment depicted is a pivoting door, other movable portions can be used in accordance with the present invention including, but not limited to, a sliding door, a bellows, or other suitable safety cover while the exercise machine 20 is in use.

Illustrated in FIG. 5, is a view from the top of the exercise machine 20 having its pedal arms 30 and rails 32 in a folded upright position. As can be seen, the frame wheels 34 define a four point base in roughly the shape of a rectangle. Because all four frame wheels 34 rest on a support surface, the wheels defined a planar boundary above which the center of gravity of the exercise machine 20 is positioned. The primary reason the center gravity is positioned above the planar boundary defined by the frame wheels 34 is that the internal working components such as the crank pulley 40 and the fly wheel 42 are contained within an area above the planar boundary. Nonetheless, having foldable pedal arms 30 and rails 32 that move to an upright and folded position which is above the planar boundary adds significantly to the stability of the exercise machine 20 when it is in an upright and folded position and also provides critical stability when moving the exercise machine 20 using the frame wheels 34. Additional stability could be made available by using handle bars 28 that are sized to be contained above the planar boundary, but since the handle bars 28 are used to maneuver the exercise machine 20 while it is being transported, a broader and more accessible handle bar provides greater control.

Illustrated in FIGS. 7 to 10 is adjustable foot platform 120 which includes a base plate 122 fixed to the pedal arm 30 and extending laterally outwardly from each side of the pedal arm 30 and defining a plurality of position holes 124 along a longitudinal line. The adjustable platform 120 also includes a foot plate 126 slidably engaged to the base plate 122 and a spring-loaded lock pin 130 that is fixed to the foot plate 126 and selectively engagable with any one of the position holes 124 on the base plate 122. The foot plate 126 may include a pair of inwardly extending lateral flanges 132 for slidably engaging the laterally extending portions of the base plate 122 to prevent inadvertent disengagement of the foot platform 120 from the pedal arm 30.

Alternatively, the base plate 122 can be fixed to the pedal arm 30, and include a plurality of position holes 124 along a longitudinal line and a movable toe piece 138 selectively engagable with any one of the position holes 124 on the base plate 122. A spring-loaded lock pin 130 can be used as described above to selectively engage any one of the position holes 124 on the base plate 122. Re-adjustment of the adjustable platform 120 or toe piece 138 can be accomplished to accommodate users of different sizes or to exercise different groups of muscles which depends upon the distance from the crank pulley 40 that the users feet are positioned.

Figure 11:
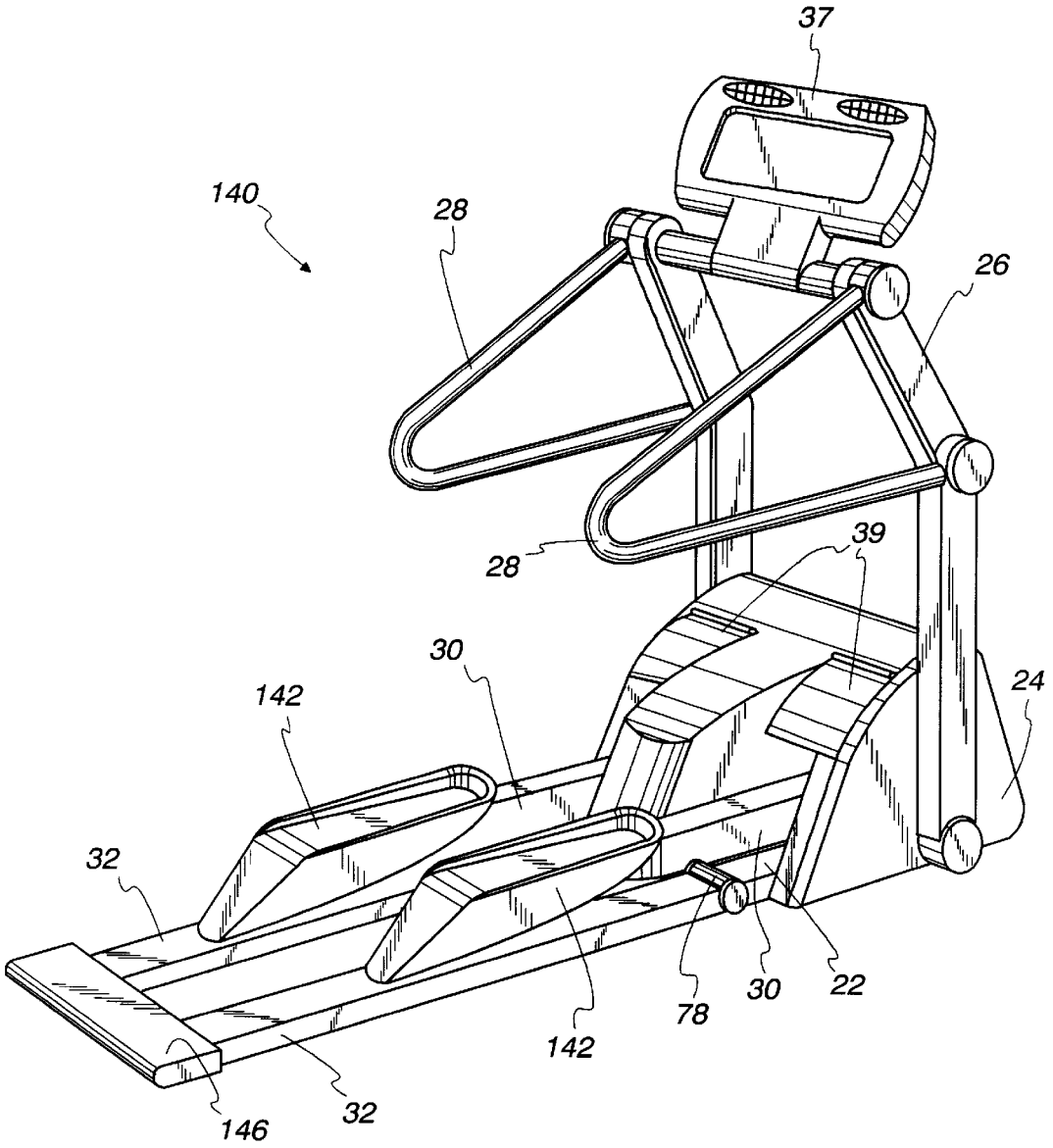
FIG. 11 is a perspective view of another embodiment of the foldable elliptical exercise machine in accordance with the present invention.

Illustrated in FIG. 11, is yet another embodiment of an exercise machine 140 the present invention incorporating many of the same features described above such as; a frame 22, a housing 24, and upright console mast 26, handle bars 28, pedal arms 30, and rails 32 joined to the frame 22 at cylindrical hinges 78. As above, the pedal arms 30 have a central portion 102 that is horizontal when internal crank arms 50 are also horizontal. In this embodiment, downwardly extended foot platform 142 that covers pedal arm wheels to provide a futuristic look. Further, the rails 32 are joined along the rear by a transverse coupling 146 that permits the rails 32 to be folded upwardly in unison, as opposed to separately.

Figure 9:
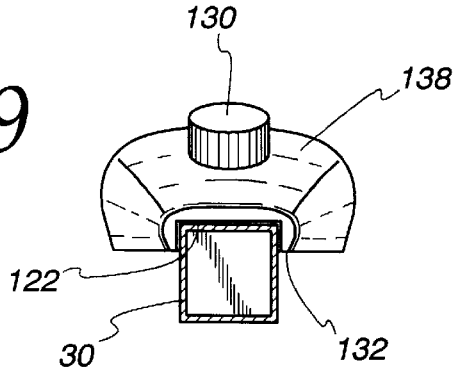
FIG. 9 is a cross-sectional view of the pedal arm taken along line 9—9 in FIG. 8.
Figure 10:
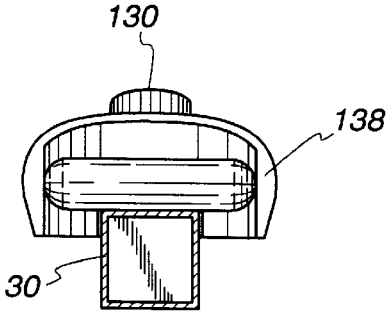
FIG. 10 is a cross-sectional view of the pedal arm taken along line 10—10 in FIG. 8.

Illustrated in FIG. 12 is an alternate embodiment for the pedal arms 30 which includes a telescoping outer tube 150 and an inner tube 152 that can be pushed into the outer tube 150 to avoid having to fold the pedal arm 30 or to reduce the overall height of the pedal arm 30 when it is in the upright folded position. Similarly, FIG. 9 illustrates an alternate embodiment for the rails 32 which can include a telescoping outer tube 158 and an inner tube 160 that can avoid the necessity of folding the rails 32 or that can reduce the overall height of the exercise machine 20 when the rails 32 are in the upright and folded position. Alternately, the pedal arms 30 or the rails 32 can be removable to reduce floor space requirements when the exercise machine 20 is not use or to reduce the overall size of the exercise machine 20 when being transported. When the pedal arms 30 or the rails 32 are removable, the frame 22 preferably will be provided with appropriate storage pockets and locks to secure the pedal arms 30 and the rails 32 for storage or transportation.

The foregoing detailed description of drawings is presented for clearness of understanding only and no unnecessary limitations therefrom should be read into the following claims.

What is claimed is:

1. An exercise device comprising:

a frame;

a crank pulley having an axis rotatably mounted on the frame;

a pair of opposing crank arms, each crank arm having a first end fixed to the crank pulley axis and a second end extending radially outwardly from the axis in a direction opposite the other crank arm;

a pair of pedal arms each having a first end rotatably joined to the second end of a respective crank arm, a central portion extending rearwardly from the pedal arm first end and a second end rearward of the central portion, and the pedal arms being pivotable between a use position and an upright folded position; and a pair of rails movably joined to the frame and each having a load bearing surface for supporting the second end of a respective pedal arm and wherein the rails are movable between a use position and a compact, non-use position.

2. The exercise device of claim 1, wherein the pedal arms each include a rear end portion extending downwardly from the central portion and terminating at the second end.

3. The exercise device of claim 1, wherein each pedal arm second end includes a wheel rotatably mounted thereon.

4. The exercise device of claim 1, wherein each pedal arm includes a foot platform mounted on the central portion.

5. The exercise device of claim 1, and further comprising:

an upwardly extending console mast fixed to the frame; and a handle bar fixed to the console mast.

6. The exercise device of claim 1, and further comprising:

a fly wheel rotatably mounted on the frame; and a drive belt for transmitting inertia from the fly wheel to the crank pulley.

7. The exercise device of claim 1, and further comprising:

a housing joined to the frame, the housing defining an interior space in which the crank pulley and crank arms are disposed, the housing having a pair of movable portions, each movable portion corresponding to a pedal arm and having a closed position corresponding to the pedal arm use position, and an open position corresponding to the pedal arm upright folded position.

8. The exercise device of claim 7, wherein the movable portions move from the open position to the closed position automatically when the pedal arms are moved from the upright folded position toward the use position.

9. The exercise device of claim 1, and further comprising:

a housing joined to the frame, the housing defining an interior space in which the crank pulley and crank arms are disposed, the housing having a pair of pivoting doors, each door corresponding to a pedal arm and having a closed position corresponding to the pedal arm use position, and an open position corresponding to the pedal arm upright folded position.

10. The exercise device of claim 9, and further comprising:

a spring for urging a pivoting door from the open position to the closed position.

11. The exercise device of claim 1, and further comprising:

a lock for releasably securing the pedal arms in the upright folded position.

12. The exercise device of claim 1, and further comprising:

a lock for releasably securing the rails in the upright folded position.

13. The exercise device of claim 1, and further comprising:

a lock for releasably securing a pedal arm to a corresponding rail when both are in the upright folded position.

14. The exercise device of claim 13, wherein the lock includes a bent wire fixed to the bottom of a pedal arm and defining a resilient hook for engaging an end of a corresponding rail.

15. The exercise device of claim 1, wherein the frame includes four spaced apart support points defining a horizontal planar boundary above which the center of gravity of the exercise device is positioned when the pedal arms are in the folded position.

16. The exercise device of claim 1, wherein the frame includes four spaced apart support points defining a horizontal planar boundary above which the center of gravity of the exercise device is positioned when the pedal arms and the rails are in the upright folded position.

17. The exercise device of claim 16, wherein at least two of the four spaced apart support points each includes a wheel.

18. The exercise device of claim 1, wherein the pedal arm central portion is horizontal when the corresponding crank arm is horizontal.

19. The exercise device of claim 1, wherein the pedal arms are removably joined to the crank arms.

20. The exercise device of claim 1, wherein the rails are removably joined to the frame.

21. The exercise device of claim 1, wherein the pedal arms each include telescoping elements.

22. The exercise device of claim 1, and further comprising:

a foot plate releasably attachable to a plurality of locations on each pedal arm.

23. An exercise device comprising:

a frame;

a crank pulley having an axis rotatably mounted on the frame;

a pair of opposing crank arms, each crank arm having a first end fixed to the crank pulley axis and a second end extending radially outwardly from the axis in a direction opposite the other crank arm;

a pair of pedal arms each having a first end rotatably joined to the second end of a respective crank arm, a central portion extending rearwardly from the pedal arm first end and a second end rearward of the central portion, and the pedal arms being pivotable between a use position and an upright folded position; and a pair of rails pivotably joined to the frame and each having a load bearing surface for supporting the second end of a respective pedal arm and the rails are pivotable between a use position and an upright folded position.

24. The exercise device of claim 23, wherein the pedal arms each include a rear end portion extending downwardly from the central portion and terminating at the second end.

25. The exercise device of claim 23, wherein each pedal arm second end includes a wheel rotatably mounted thereon, the wheel for rolling on a respective folding rail.

26. The exercise device of claim 23, wherein each pedal arm includes a foot platform mounted on the central portion.

27. The exercise device of claim 23, and further comprising:

an upwardly extending console mast fixed to the frame, and a handle bar fixed to the console mast.

28. The exercise device of claim 23, and further comprising:

a fly wheel rotatably mounted on the frame; and a drive belt for transmitting inertia from the fly wheel to the crank pulley.

29. The exercise device of claim 23, and further comprising:

a housing joined to the frame, the housing defining an interior space in which the crank pulley and crank arms are disposed, the housing having a pair of movable portions, each movable portion corresponding to a pedal arm and having a closed position corresponding to the pedal arm use position, and an open position corresponding to the pedal arm upright folded position.

30. The exercise device of claim 29, wherein the movable portions move from the open position to the closed position automatically when the pedal arms move from the upright folded position to the use position.

31. The exercise device of claim 23, and further comprising:

a housing joined to the frame, the housing defining an interior space in which the crank pulley and crank arms are disposed, the housing having a pair of pivoting doors, each door corresponding to a pedal arm and having a closed position corresponding to the pedal arm use position, and an open position corresponding to the pedal arm upright folded position.

32. The exercise device of claim 31, and further comprising:

a spring for urging a pivoting door from the open position to the closed position.

33. The exercise device of claim 23, and further comprising:

a lock for releasably securing the pedal arms in the upright folded position.

34. The exercise device of claim 23, and further comprising:

a lock for releasably securing the rails in the upright folded position.

35. The exercise device of claim 23, wherein the rails are pivotable between a use position and an upright folded position, and further comprising:

a lock for releasably securing a pedal arm to a corresponding rail when both are in the upright folded position.

36. The exercise device of claim 35, wherein the lock includes a bent wire fixed to the bottom of a pedal arm and defining a resilient hook for engaging an end of a corresponding rail.

37. The exercise device of claim 23, wherein the frame includes four spaced apart support points defining a horizontal planar boundary above which the center of gravity of the exercise device is positioned when the pedal arms are in the folded position.

38. The exercise device of claim 23, wherein the pedal arm central portion is horizontal when the corresponding crank arm is horizontal.

39. The exercise device of claim 23, wherein the frame includes four spaced apart support points defining a horizontal planar boundary above which the center of gravity of the exercise device is positioned when the pedal arms and the rails are in the upright folded position.

40. The exercise device of claim 39, wherein at least two of the four spaced apart support points each includes a wheel.

41. The exercise device of claim 23, wherein the pedal arms are removably joined to the crank arms.

42. The exercise device of claim 23, wherein the rails are removably joined to the frame.

43. The exercise device of claim 23, wherein the pedal arms each include telescoping elements.

44. The exercise device of claim 23, and further comprising:

a foot plate releasably attachable to a plurality of locations on a corresponding pedal arm.

45. An exercise device comprising:

a frame;

a crank pulley having an axis rotatably mounted on the frame;

a pair of opposing crank arms, each crank arm having a first end fixed to the crank pulley axis and a second end extending radially outwardly from the axis in a direction opposite the other crank arm;

a pair of pedal arms each having a first end rotatably joined to the second end of a respective crank arm, a central portion extending rearwardly from the pedal arm first end and a second end rearward of the central portion, and the pedal arms being pivotable between a use position and an upright folded position;

a pair of rails pivotably joined to the frame and each having a load bearing surface for supporting the second end of a respective pedal arm and the rails are pivotable between a use position and an upright folded position; and a housing joined to the frame, the housing defining an interior space in which the crank pulley and crank arms are disposed, the housing having a movable portion, the movable portion having a closed position corresponding to the pedal arm use position, and an open position corresponding to the pedal arm upright folded position.

46. The exercise device of claim 45, wherein the pedal arms each include a rear end portion extending downwardly from the central portion and terminating at the second end.

47. The exercise device of claim 45, wherein each pedal arm second end includes a wheel rotatably mounted thereon, the wheel for rolling on a respective folding rail.

48. The exercise device of claim 45, wherein each pedal arm includes a foot platform mounted on the central portion.

49. The exercise device of claim 46, and further comprising:

an upwardly extending console mast fixed to the frame; and a handle bar fixed to the console mast.

50. The exercise device of claim 45, and further comprising:

a fly wheel rotatably mounted on the frame; and a drive belt for transmitting inertia from the fly wheel to the crank pulley.

51. The exercise device of claim 45, wherein the movable portion includes a pivoting door.

52. The exercise device of claim 45, and further comprising:

a spring for urging the movable portion from the open position to the closed position.

53. The exercise device of claim 45, and further comprising:

a lock for releasably securing the pedal arms in the upright folded position.

54. The exercise device of claim 45, and further comprising:

a lock for releasably securing the rails in the upright folded position.

55. The exercise device of claim 45, and further comprising:

a lock for releasably securing a pedal arm to a corresponding rail when both are in the upright folded position.

56. The exercise device of claim 55, wherein the lock includes a bent wire fixed to the bottom of a pedal arm and defining a resilient hook for engaging an end of a corresponding rail.

57. The exercise device of claim 45, wherein the frame includes four spaced apart support points defining a horizontal planar boundary above which the center of gravity of the exercise device is positioned when the pedal arms are in the folded position.

58. The exercise device of claim 45, wherein the frame includes four spaced apart support points defining a horizontal planar boundary above which the center of gravity of the exercise device is positioned when the pedal arms and the rails are in the upright folded position.

59. The exercise device of claim 58, wherein at least two of the four spaced apart support points each includes a wheel.

60. The exercise device of claim 45, wherein the pedal arm central portion is horizontal when the corresponding crank arm is horizontal.

61. The exercise device of claim 45, wherein the pedal arms are removably joined to the crank arms.

62. The exercise device of claim 45, wherein the rails are removably joined to the frame.

63. The exercise device of claim 45, wherein the pedal arms each include telescoping elements.

64. The exercise device of claim 45, and further comprising:

a foot plate releasably attachable to a plurality of locations on a corresponding pedal arm.

65. An exercise device comprising:

a frame;

a crank pulley having an axis rotatably mounted on the frame;

a pair of opposing crank arms, each crank arm having a first end fixed to the crank pulley axis and a second end extending radially outwardly from the axis in a direction opposite the other crank arm;

a pair of pedal arms each having a first end rotatably joined to the second end of a respective crank arm, a central portion extending rearwardly from the pedal arm first end and a second end rearward of the central portion, and the pedal arms each include a rear end portion extending downwardly from the central portion and terminating at the second end, wherein the pedal arm central portion is horizontal when the corresponding crank arm is horizontal and a pair of rails pivotally joined to the frame and each having a load bearing surface for supporting the second end of a respective pedal arm and wherein the rails are pivotable between a use position and an upright folded position.

66. The exercise device of claim 65, wherein each pedal arm is foldable from a use position to an upright folded position.

67. The exercise device of claim 65, wherein each pedal arm second end includes a wheel rotatably mounted thereon.

68. The exercise device of claim 65, wherein each pedal arm includes a foot platform mounted on the central portion.

69. The exercise device of claim 65, and further comprising:

an upwardly extending console mast fixed to the frame; and a handle bar fixed to the console mast.

70. The exercise device of claim 65, and further comprising:

a fly wheel rotatably mounted on the frame; and a drive belt for transmitting inertia from the fly wheel to the crank pulley.

71. The exercise device of claim 66, and further comprising:

a housing joined to the frame, the housing defining an interior space in which the crank pulley and crank arms are disposed, the housing including a movable portion having a position corresponding to the pedal arm use position, and an open position corresponding to the pedal arm upright folded position.

72. The exercise device of claim 71, wherein the movable portion moves automatically from the open position to the closed position.

73. The exercise device of claim 66, further comprising:

a lock for releasably securing the pedal arms in the upright folded position.

74. The exercise device of claim 66, and further comprising:

a lock for releasably securing the rails in the upright folded position.

75. The exercise device of claim 66, wherein the rails are pivotable between a use position and an upright folded position, and further comprising:

a lock for releasably securing a pedal arm to a corresponding rail when both are in the upright folded position.

76. The exercise device of claim 75, wherein the lock includes a bent wire fixed to the bottom of a pedal arm and defining a resiliently hook for engaging an end of a corresponding rail.

77. The exercise device of claim 66, wherein the frame includes four spaced apart support points defining a horizontal planar boundary above which the center of gravity of the exercise device is positioned when the pedal arms are in the folded position.

78. The exercise device of claim 66, wherein the frame includes four spaced apart support points defining a horizontal planar boundary above which the center of gravity of the exercise device is positioned when the pedal arms and the rails are in the upright folded position.

79. The exercise device of claim 66, wherein at least two of the four spaced apart support points each includes a wheel.

80. The exercise device of claim 65, wherein the pedal arms are removably joined to the crank arms.

81. The exercise device of claim 65, wherein the rails are removably joined to the frame.

82. The exercise device of claim 65, wherein the pedal arms each include telescoping elements.

83. The exercise device of claim 65, and further comprising:

a foot plate releasably attachable to a plurality of locations on each pedal arm.

* * * * *